United States Patent [19]

Long

[11] Patent Number: 4,650,084

[45] Date of Patent: Mar. 17, 1987

[54] COLLAPSIBLE BOX

[76] Inventor: Robert W. Long, 231 E. Main St., Lebanon, Ohio 45036

[21] Appl. No.: 754,357

[22] Filed: Jul. 11, 1985

[51] Int. Cl.[4] ..... B65D 8/14

[52] U.S. Cl. ..... 217/12 R; 217/43 R; 217/43 A; 217/71

[58] Field of Search ..... 217/12 R, 43 R, 43 A, 217/51, 24, 65, 66, 69, 70, 71

[56] References Cited

U.S. PATENT DOCUMENTS

| | | | |
|---|---|---|---|
| 669,728 | 3/1901 | Heagerty | 217/43 |
| 910,792 | 1/1909 | Dahl | 217/43 |
| 2,154,538 | 4/1939 | Stivers | 217/43 |
| 2,901,141 | 8/1959 | Dedmon | 217/43 A |
| 3,027,038 | 3/1962 | Kordowski | 217/12 R |
| 3,080,992 | 3/1963 | Dedmon | 217/43 A |
| 3,323,674 | 6/1967 | Nist, Jr. | 217/43 A |
| 3,878,795 | 4/1975 | Janda | 217/43 A |
| 4,277,878 | 7/1981 | O'Neal | 217/43 R |
| 4,300,694 | 11/1981 | Wait et al. | 217/43 R |

*Primary Examiner*—Joseph Man-Fu Moy

*Attorney, Agent, or Firm*—Wood, Herron & Evans

[57] ABSTRACT

A collapsible box having sidewalls secured together at the corners of the box by first and second loop elements fastened to two adjacent sidewalls. As disclosed, each loop element includes two tapered end portions adjacent one another driven into a sidewall, to secure the loop element thereto, and two elongated portions extending along the sidewall from the tapered end portions, terminating in a loop at a corner of the box. The sidewalls of the box meet at the corner to produce a recess, and a fastening wire is passed through the loops of the loop elements on the two adjacent sidewalls, with the ends of the wire twisted together to secure the two loop elements to one another in the recess. The forces produced serve to hold the box together and to hold the loop elements against the sidewalls. The loop elements are also stapled to the sidewalls.

5 Claims, 4 Drawing Figures

COLLAPSIBLE BOX

DESCRIPTION OF THE INVENTION

This invention relates generally to containers for cargo or freight and more particularly concerns a container such as a box which can be collapsed when not in use.

In transporting cargo of various types, shipping containers of wood, fiber board, or the like are used to hold and protect the cargo. One common type of container is a box having rigid sidewalls, typically constructed of wood, resting upon a pallet and including a cover or lid to complete the enclosure. Once the cargo has reached its destination, the box is dismantled and discarded.

Due to the cost of construction of such rigid containers, collapsible boxes have been produced so that when such a box is not in use it may be collapsed for storage or for return to the point of origination of the cargo for re-use.

Such prior collapsible boxes have taken a number of forms. Some are held together by fairly elaborate arrangements of encircling wires and/or metal bands. These types of collapsible boxes present difficulties in re-assembly and disassembly.

Another common type of shipping box includes four sides, which are substantially vertical when the box is in use, each side having several vertical slats held together by a number of horizontal cleats. The sidewalls either rest upon or are secured to a base or pallet, and a suitable cover or lid may be additionally provided.

In a collapsible box of this type, in one prior construction, the sidewalls are held together at the corners by interlooped wire elements, the ends of which are permanently secured between adjacent cleats and slats. Such a sidewall structure relies for its rigidity upon a rectangular border on the pallet base upon which the walls are positioned. When the four walls are removed from the base, the interlooped connecting elements at the corners are sufficiently loose to permit the sidewalls to collapse into a flattened condition. In the collapsed condition of this type of box, the sidewalls are not disconnected from one another since the interlooped wire elements are permanently secured to the sidewalls.

In another collapsible box having sidewalls of the same general type as that described above, holes are drilled through the cleats which are adjacent one another at each of the corners of the box. Then, to releasably secure the sidewalls together, a single wire loop element is passed through the bores through the cleats, with the ends of the wire element then twisted together. This type of attachment of the collapsible box sidewalls, while permitting disassembly of the walls from one another, fails to provide a particularly rigid connection for the sidewalls.

It is the general aim of the present invention to provide an improved collapsible box of the foregoing type in which the sidewalls are secured together in a fashion that they may be readily disassembled from one another and yet, when assembled, provide a relatively rigid and sturdy structure. It has been an objective to accomplish this sidewall interconnection without the additional requirement of encircling wires and/or metal bands to maintain the rigidity of the container.

In one embodiment of the invention the collapsible box takes the form of four interconnected sidewalls made up of slats and cleats, in which at each corner the cleats of adjacent sidewalls are releasably secured together utilizing two loop elements and a fastening wire. In this form of the invention, each adjacent cleat carries a loop element which is secured thereto, with the loops of each loop element being secured to one another by a wire. The wires holding the loop elements together may subsequently be removed in order to disassemble the box.

In another form of collapsible box in accordance with the invention, the pairs of loop elements at the corners of the box are interconnected, with one loop being received within the other loop and then bent back upon itself. In this way the two loops are releasably secured together, but without the requirement of using a separate securing wire.

In both forms of the collapsible box disclosed herein, it is preferred that, at the meeting point at a corner of each two adjacent cleats, the cleats adjoin in a fashion to provide a recess at the corner. The two loop elements, when fastened together, are then drawn into the recess so that the forces acting on the loop elements are exerted inwardly and not in a direction to tend to pull the loop elements away from the cleats.

In accordance with a further object of the invention, the four walls of a collapsible box constructed in accordance with the invention are secured to a pallet or base using loop elements which are secured together in a fashion similar to that employed for the loop elements at the corners.

Other objects and advantages of the invention, and the manner of their implementation, will become apparent upon reading the following detailed description and upon reference to the drawings, in which.

Figure 1:
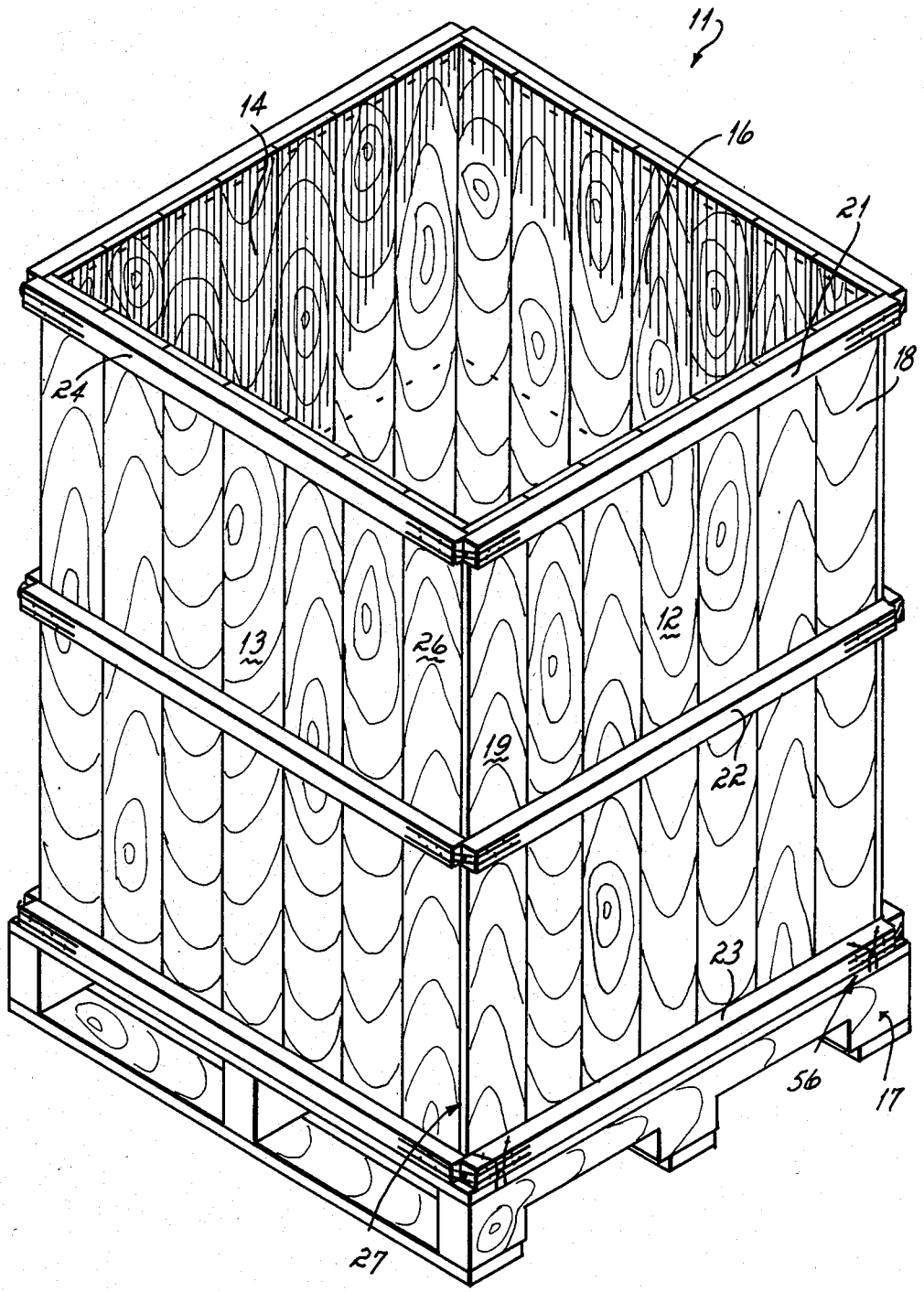
FIG. 1 is a perspective view of a collapsible box constructed in accordance with the present invention.

While the invention is susceptible to various modifications and alternative forms, certain illustrative embodiments have been shown by way of example in the drawings and will herein be described in detail. It should be understood, however, that it is not intended to limit the invention to the particular form disclosed, but, on the contrary, the intension is to cover all modifications, equivalents, and alternatives falling within the spirit and scope of the invention as defined by the appended claims.

With reference now to FIG. 1, a collapsible box 11 includes four vertical sides 12, 13, 14 and 16. The four vertical sidewalls are mounted on a pallet base 17, which forms a bottom of the collapsible box 11. While the illustrated box 11 includes the four sides 12–16, and the base 17, and has no cover or lid, other forms of collapsible box embodying the invention are contemplated. For example, for some applications, the collapsible box may include only the sidewalls 12, 13, 14 and 16, while in other situations the box may include both a base and a lid.

Each sidewall of the box 11 includes a number of vertical slats secured together by several horizontal cleats. For example, the sidewall 12 includes seven vertical slats such as 18 and 19 and three horizontal cleats 21, 22 and 23. The cleats 21–23 are secured to the slats such as 18 and 19 by suitable nails or staples.

Figure 2:
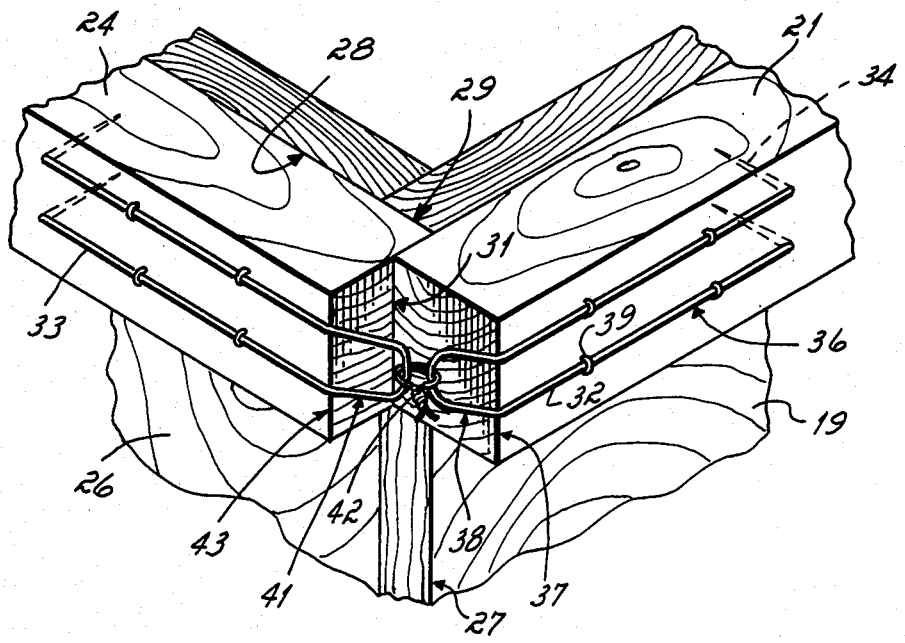
FIG. 2 is an enlarged perspective view of a corner of the box of FIG. 1.

With additional reference now to FIG. 2, each of the four corners or the box 11 are releasably secured together to permit collapsing the box when it is not in use. At each box corner the three cleats on adjacent sides of the box meet at the top, the middle and the bottom of the corner. For example, at the top of the corner 27 between the walls 12 and 13, the cleats 21 and 24 meet in a partially overlapping relationship. As best seen in FIG. 2, in the illustrated form of the invention, the adjacent slats 19 and 26 at the corner overlap so that the slat 19 extends at its end to the outer edge 28 of the slat 26, producing a "square" corner. However, the cleat 21 on the wall 12 extends only partially beyond the inner edge 29 of the cleat 24 on the wall 13. This defines a recess 31 at the corner in the vicinity of the cleats 21, 24.

In order to secure the adjacent cleats such as 21, 24 together, a first loop element 32 is secured to the cleat 21, and a second loop element 33 is secured to the cleat 24 and the two loop elements releasably fastened together within the recess 31.

To secure the loop element 32 to the cleat 21, the loop element includes a pair of tapered end portions 34 which are driven into the cleat. A pair of elongated portions 36 of the loop element 32 extend along the cleat 21 to the end 37 of the cleat. The two elongated portions 36 terminate in a loop portion 38 at the corner 27. The elongated portions 36 of the loop element 32 are further secured to the cleat 21 by staples such as 39. The staples are preferably applied utilizing a staple gun having a slotted head to accommodate the portions 36 of the loop element 32.

The loop element 33 is secured to the cleat 24 in the same fashion that the loop element 32 is secured to the cleat 21, and consequently the mode of attachment shall not be described in detail. The loop element 33 terminates in a loop portion 41 at the corner 27 adjacent the loop portion 38 of the loop element 32. In order to fasten the two loop elements 32, 33 together, a wire 42 is passed through the loop portions 38, 41 and the free ends of the wire 42 twisted together to tighten the wire. Tightening the wire 42 draws the two loop elements 32, 33 more tightly together and bends the elongated portions of the loop elements at the corners 37, 43 of the cleats 21, 24, respectively, drawing the loop portions 38, 41 of the loop element into the recess 31. In this way, the resultant force pulling the loop elements together is not only directed along the cleats, tending to pull them toward the corner, but also inwardly as the loop portions 38, 41 are drawn into the recess 31 by the tightening of the wire 42.

Figure 3:
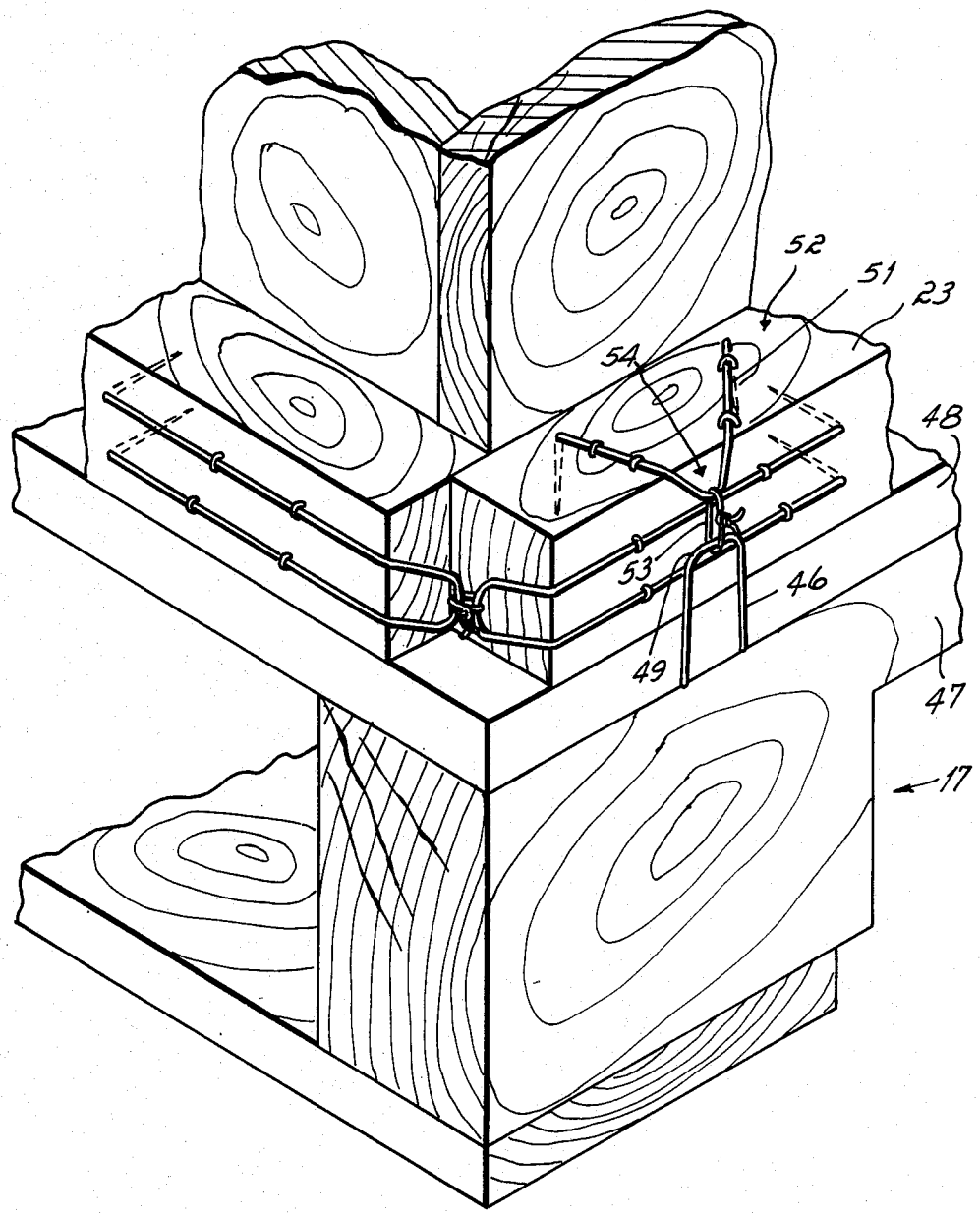
FIG. 3 is an enlarged perspective view of a bottom portion of the box of FIG. 1.

With additional reference to FIG. 3, the bottom cleat of each of at least two of the sidewalls, such as the cleat 23 of the sidewall 12, is secured by two interconnected loop elements to the base 17. In order to do this, a first loop element 46, similar to the loop elements 32 and 33, is secured between a runner 47 and a baseboard 48 of the base 17, leaving the loop portion 49 of the loop element 46 exposed. The loop element 46 may be secured, for example, to the runner 47 by driving tapered end portions (not shown) of the loop element into the runner before the baseboard 48 is attached to the runner. A second loop element 51 is secured to the upper surface 52 of the cleat 23. A wire 53 is then looped through the loop portion 49 of the loop element 46 and a loop portion 54 of the loop element 51. The free ends of the wire 53 are twisted together drawing the loop elements 51 and 46 together. Additional interconnected loop elements, such as the loop element pair 56 (FIG. 1) at locations around the base of the collapsible box 11 secure the sidewalls 12–16 to the pallet base 17.

Figure 4:
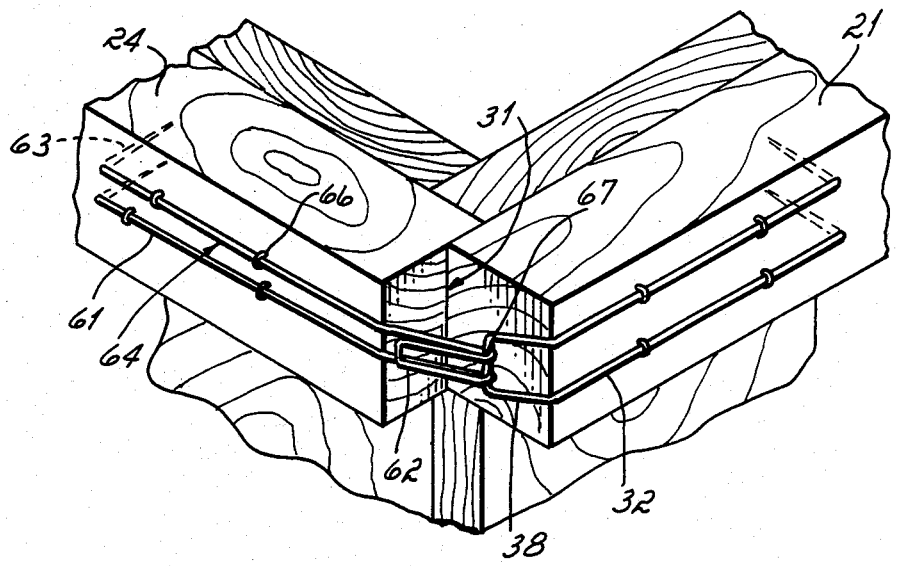
FIG. 4 is an enlarged perspective view of a corner of another form of collapsible box in accordance with the invention.

With reference now to FIG. 4, an alternative interconnection arrangement for the loop elements holding the collapsible box 11 together dispenses with the use of a wire to hold two loop elements together. As shown in FIG. 4, the loop element 32 is secured to the cleat 21 in substantially the same manner as illustrated in FIG. 2. To connect the cleat 21 to the cleat 24, a second loop element 61 is secured to the cleat 24 and includes an elongated loop portion 62 of sufficient length to extend past the corner recess 31. The loop element 61 is secured to the cleat 24 in the same manner as the loop element 32 is secured to the cleat 21. That is, the loop element 61 includes a pair of tapered ends 63 driven into the cleat 24 and a pair of elongated portions 64 secured to the cleat by staples such as 66.

In order to fasten the two loop elements 61, 32 together, the loop portion 62 of the loop element 61 is inserted through the loop portion 38 of the loop element 32 and bent back upon itself, tightening the two loop elements together. In tightening the two loop elements together, the force-bearing points such as 67 between the two loop elements are drawn into the recess 31. This provides an inward direction to the securing force as is produced in the interconnection arrangement shown in FIGS. 1 and 2.

In the illustrated form of the invention, the loop elements such as 32 are wire pipe hooks such as are produced by Western Wire Products Co. of St. Louis, MO. Advantageously, employing the sidewall interconnection means of the present invention, the wires such as 42 can be removed from the loop elements at the box corners, permitting total disassembly of the collapsible box. In order to reform the box, the sidewalls need merely be arranged in the proper relationship to one another and suitable wires employed to reconnect the various loop elements. The same disassembly and re-assembly technique is employed for the interconnection between the sidewalls and the pallet base. In the alternative loop interconnection arrangement of FIG. 4, the loop elements, such as the loop element 61, need merely be straightened at the loop portion end of the loop element and removed from the adjacent loop element in order to disassemble the collapsible box.

While only certain illustrative embodiments of the present invention have been described, those persons skilled in the art to which the invention pertains will readily appreciate numerous changes and modifications which may be made without departing from the spirit of the invention. For example, the precise construction of the sidewalls is not critical to the invention so that certain details such as the number of slats 18, 19 or the presence or absence of spacing therebetween, or the provision of additional bracing boards or cleats, would not affect the practice of the present invention.

What is claimed is:

1. A collapsible box comprising:

four substantially vertical sidewalls meeting at four corners, a plurality of generally horizontally disposed cleats vertically spaced along each of said sidewalls, said cleats being formed with two ends each having an outside corner, said cleats meeting at the ends so that said outside corner of one cleat is spaced from the outside corner of an adjoining cleat forming a recess therebetween;

a plurality of loop elements each comprising a length of wire bent in a loop at one end to form a loop portion at the bend and a pair of spaced, parallel leg portions of substantially the same length extending outwardly from the bend, each of said leg portions having a free end with a tapered nail portion extending transversely thereto;

said tapered nail portions being driven into said cleats to mount one of said loop elements near each end of said cleats so that said loop portion of each said loop elements extends over said outside corner of said cleats and into said recess;

means for securing said leg portions of said loop elements to said cleats to prevent vertical movement of said leg portions with respect to said cleats;

tie means connecting the loop portion of one loop element with the loop portion of an adjoining loop element for releasably securing said loop portions together within said recess.

2. The collapsible box of claim 1 in which said tie means for releasably securing said loop portions together comprises a wire, passing through the loop portions of the loop elements, having two free ends twisted together.

3. The collapsible box of claim 1 in which said tie means for releasably securing said loop portions together comprises an elongated loop portion formed in one of said loop elements, said elongated loop portion extending through said loop portion of an adjoining loop element and being bent back upon itself to releasably secure said loop portions together within said recess.

4. The collapsible box of claim 1 in which the leg portions of each loop element are secured to an associated cleat by staples.

5. The collapsible box of claim 1 which further comprises (i) a pallet base beneath the side walls, each side wall having a bottom edge and a bottom cleat adjacent the bottom edge, (ii) a first plurality of bottom loop elements secured to the bottom cleats, (iii) a second plurality of bottom loop elements secured to the pallet base, and (iv) means for releasably securing together (a) each loop element of the first plurality of bottom loop elements and (b) an associated bottom loop element of the second plurality of bottom loop elements, thereby securing the side walls of the collapsible box to the pallet base.

* * * * *